US007900592B2

(12) United States Patent
Boesel

(10) Patent No.: US 7,900,592 B2
(45) Date of Patent: Mar. 8, 2011

(54) SWITCHABLE COMPONENT FOR A VALVE TRAIN OF AN INTERNAL COMBUSTION ENGINE

(75) Inventor: Christian Boesel, Nuremberg (DE)

(73) Assignee: Schaeffler KG, Herzogenaurach (DE)

( * ) Notice: Subject to any disclaimer, the term of this patent is extended or adjusted under 35 U.S.C. 154(b) by 293 days.

(21) Appl. No.: 12/248,274

(22) Filed: Oct. 9, 2008

(65) Prior Publication Data

US 2009/0145378 A1 Jun. 11, 2009

Related U.S. Application Data

(60) Provisional application No. 60/978,897, filed on Oct. 10, 2007.

(51) Int. Cl.
*F01L 1/14* (2006.01)

(52) U.S. Cl. ..... 123/90.5; 123/90.52; 123/90.48

(58) Field of Classification Search ..... 123/90.48, 123/90.52, 90.55, 90.5
See application file for complete search history.

(56) References Cited

U.S. PATENT DOCUMENTS

| | | | | |
|---|---|---|---|---|
| 4,089,234 | A | 5/1978 | Henson et al. | |
| 5,263,386 | A | 11/1993 | Campbell et al. | |
| 5,307,769 | A | 5/1994 | Meagher et al. | |
| 2003/0051689 | A1 * | 3/2003 | Schnell | 123/90.48 |

FOREIGN PATENT DOCUMENTS

| | | | |
|---|---|---|---|
| DE | 101 19 366 | Y | 10/2002 |
| DE | 10 2006 007 489 | Y | 9/2006 |

* cited by examiner

*Primary Examiner* — Zelalem Eshete
(74) *Attorney, Agent, or Firm* — Lucas & Mercanti, LLP

(57) ABSTRACT

A switchable component for a valve train of an mternal combustion engine, comprising a housing, a coupling means, an inner element being biased by at least one lost motion spring, a stop means, and an anti-rotation device configured as a thin-walled ring comprising a slit, a rectangular extension projects inwards from a central position from the inner peripheral surface of the ring which extends parallel to a transversal plane of the component on an outer peripheral surface of the housing, the housing comprises an aperture that is complementary in shape to the extension of the ring and said extension extends through said aperture, a counter surface for the extension extends in the form of a longitudinal flattened portion or a longitudinal groove in the outer peripheral surface of the inner element, and the extension extends with a complementary inner surface directly on or into said counter surface.

8 Claims, 2 Drawing Sheets

SWITCHABLE COMPONENT FOR A VALVE TRAIN OF AN INTERNAL COMBUSTION ENGINE

FIELD OF THE INVENTION

The invention concerns a switchable component for a valve train of an internal combustion engine, said component comprising a housing in whose bore an axially displaceable inner element is received, at least one coupling means being arranged in the inner element, said coupling means, for effecting coupling [axially distant relative position of the inner element to the housing], being able to be brought partially into engagement with an entraining surface of the housing, the inner element being biased in outward direction from the housing by at least one lost motion spring, an axially fully extended position of the inner element being defined by a stop means overlapping an annular groove between the inner element and the housing, and an anti-rotation device being arranged between the inner element and the housing.

BACKGROUND OF THE INVENTION

A component of the pre-cited type, configured, for instance, as a switchable support element is sufficiently well-known in the technical field. The anti-rotation device can be configured in the form of crosswise extending pin that is fixed in a reception of one of the components (housing or inner element) and projects into a corresponding groove on the respective other one of the components. This pin is pressed, for instance, into the aforesaid reception. It is clear to a person skilled in the art that this interference fit can get disengaged during operation of the valve train. In addition, this pressing-in is accompanied by an undesired introduction of force into the surrounding material. Furthermore, said pin cannot be removed in case dismounting becomes necessary (selective pairing of pins grouped according to thickness for adjusting a coupling lash . . . ).

OBJECTS OF THE INVENTION

It is an object of the invention to provide a switchable component of the pre-cited type in which the aforesaid drawbacks are eliminated with simple measures.

SUMMARY OF THE INVENTION

The invention achieves the above objects by the fact that the anti-rotation device is a thin-walled ring comprising a slit, a central rectangular extension [situated diametrically opposite the slit] projects inwards from the inner peripheral surface of said ring which extends parallel to a transversal plane of the component on an outer peripheral surface of the housing, the housing comprises an aperture that is complementary in shape to the extension of the ring and said extension extends through said aperture, a counter surface for the extension extends in the form of a longitudinal flattened portion or a longitudinal groove in the outer peripheral surface of the inner element and, for effecting anti-rotation, the extension extends with a complementary inner surface directly on or into said counter surface.

Thus a switchable component such as a switchable support element or a switchable roller or mushroom-type tappet that is free of the aforesaid drawbacks is created. The proposed, thin-walled slit ring can be manufactured extremely economically and it is assured in a very simple manner that the ring cannot get disengaged or change its position during operation. In case of a torque being applied by the inner element, during installation of the aforesaid component in a surrounding structure, such as a cylinder head, a support for the ring in radially outward direction is given on the cylinder head, so that the ring cannot be spread further in radially outward direction.

The ring according to the invention can be made, for example, of a simple spring steel or the like. However, it is also conceivable to make it out of a plastic material or the like. Additionally, it is both conceivable and intended to use a readily available mass product to make the inventive ring by modifying only the extension.

Through the annular groove in the outer peripheral surface of the housing proposed by the invention, the ring is axially fixed in a simple manner and loss of the ring is prevented. If necessary, a plurality of extensions may be provided on the inner peripheral surface of the ring to project radially inwards and cooperates with corresponding apertures in the housing.

It is particularly advantageous for the ring to have a C-shaped profile but, if need be, it may also have a U-shaped or similar profile, and it is particularly preferable for the ring to surround more than half of an outer peripheral surface of the housing.

Optionally, through an underside of its extension, the ring can at the same time form a stop for an outward movement of the inner element out of the housing. In this way, a maximum extended position of the inner element is defined for transportation but also during operation. However, in this connection, it is particularly preferable for the ring to be used at the same time to adjust a coupling position of the coupling means (for example at least one piston-like slide) with coupling lash. This coupling lash is adjusted by using off-the-shelf rings grouped in thicknesses, but the variation of the coupling lash should be kept as low as possible over a large series of components. By coupling lash is to be understood an idle motion that the inner element, with extended coupling means and in its stop position on the ring, has to execute in direction of the housing till the coupling means comes to abut on the corresponding entraining surface of the housing.

The entraining surface of the housing is configured, for instance, as an aperture or lenticular cavity or the like for each coupling means. Also conceivable is an annular groove or the like.

Alternatively to the aforesaid, it is also possible to use a circlip or a stack of circlips as a stop means that is seated in an annular groove on the inner peripheral surface of the housing. For effecting stopping, a lower surface of an appropriate diameter reduction of the outer peripheral surface of the inner element comes to abut against a lower edge of the circlip. This circlip or stack of circlips can be used at the same time for adjusting the aforesaid coupling position of the coupling means with coupling lash relative to its entraining surface. It is conceivable and intended in this connection to hold in stock the circlip (or, in the case of a circlip stack, at least one of the circlips) grouped according to thickness.

Where appropriate, the switchable component may also be a switchable cup tappet. In this case, too, it is conceivable and intended to arrange the coupling, means in the housing and displace it radially inwards in direction of the inner element for achieving coupling.

BRIEF DESCRIPTION OF THE DRAWING

The invention will now advantageously be explained more closely with reference to the appended drawing in which.

DETAILED DESCRIPTION OF THE DRAWING

Figure 1:
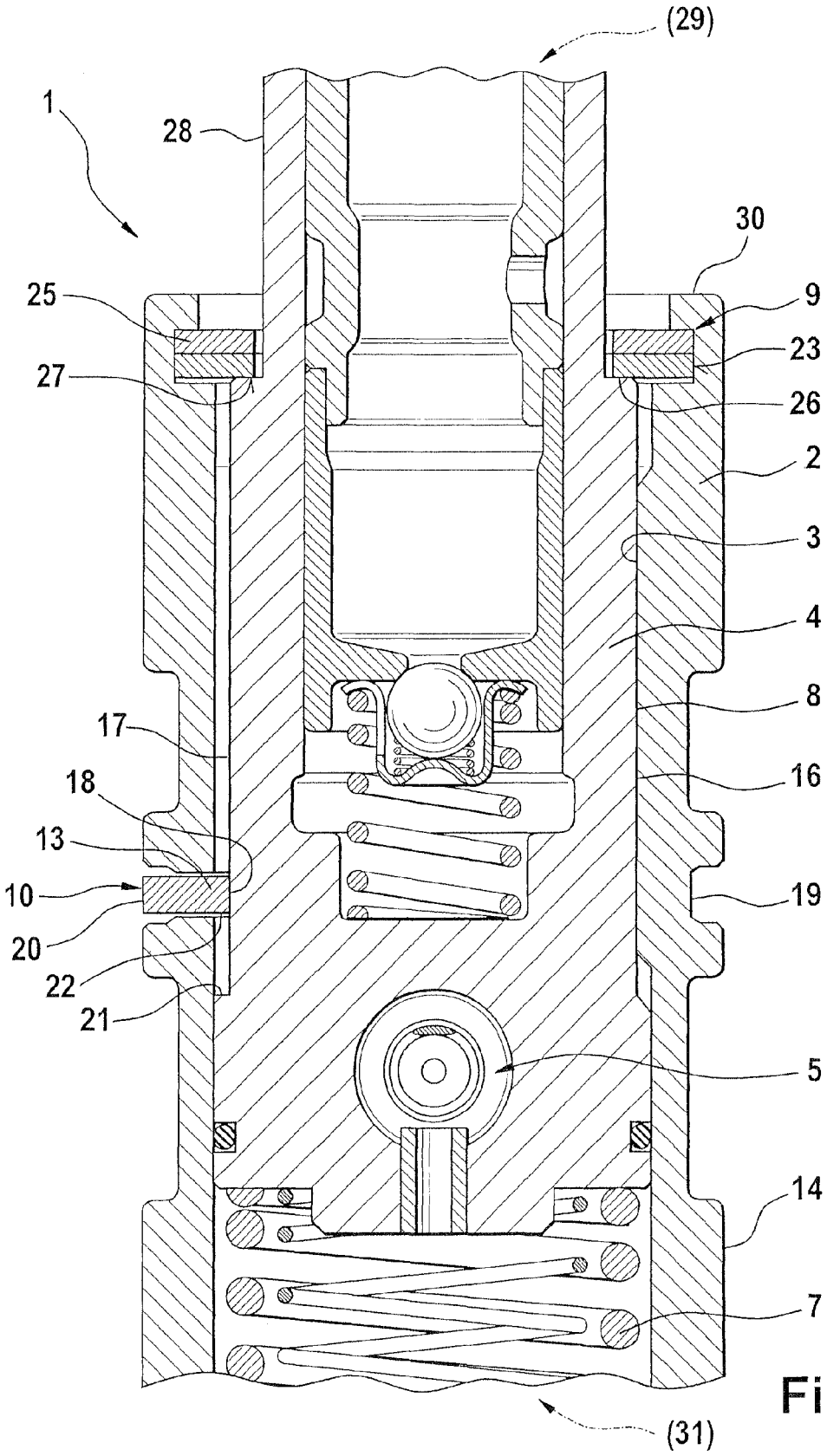
FIG. 1 shows a longitudinal section through a switchable component, configured in this example as a switchable support element.

The figures show a switchable component 1, configured in the present case as a support element for a valve train of an internal combustion engine. The component 1 has a hollow cylindrical housing 2 comprising a bore 3. In this bore 3 is seated, for axial displacement relative to an inner peripheral surface 24 of the housing 2, an inner element 4. This inner element 4 is biased in a direction leading out of the housing 2 by a lost motion spring 7 configured in the present case as a coiled spring (or a stack of coiled compression springs).

As indicated in FIG. 1, at least one coupling means 5 configured as a piston is seated in a radial bore of the inner element 4. For coupling the inner element 4 to the housing 2, this coupling means 5 can be displaced into an entraining surface 6 (see indications in FIG. 2) by partially overlapping an annular groove 8 between the housing 2 and the inner element 4. The entraining surface 6 is configured, for example, as a lenticular cavity or a milled recess or the like.

FIG. 1 additionally discloses that an extended position of the inner element 4 out of the housing 2 is defined by a stop means 9 which, in the present case, is configured as a stack of circlips 25 and disposed in an annular groove 23 in the inner peripheral surface 24 of the housing 2. Advantageously, this stack of circlips 25 at the same time adjusts a coupling position of the coupling means 5 with coupling lash relative to its entraining surface 6. Appropriately, the uppermost circlip is kept in stock in different thickness groups for assembly. Alternatively, the stack of circlips or the circlip may also be connected to the inner element 4 and cooperate with a corresponding counter surface on the bore 3 of the housing 2 for effecting stopping.

Figure 2:
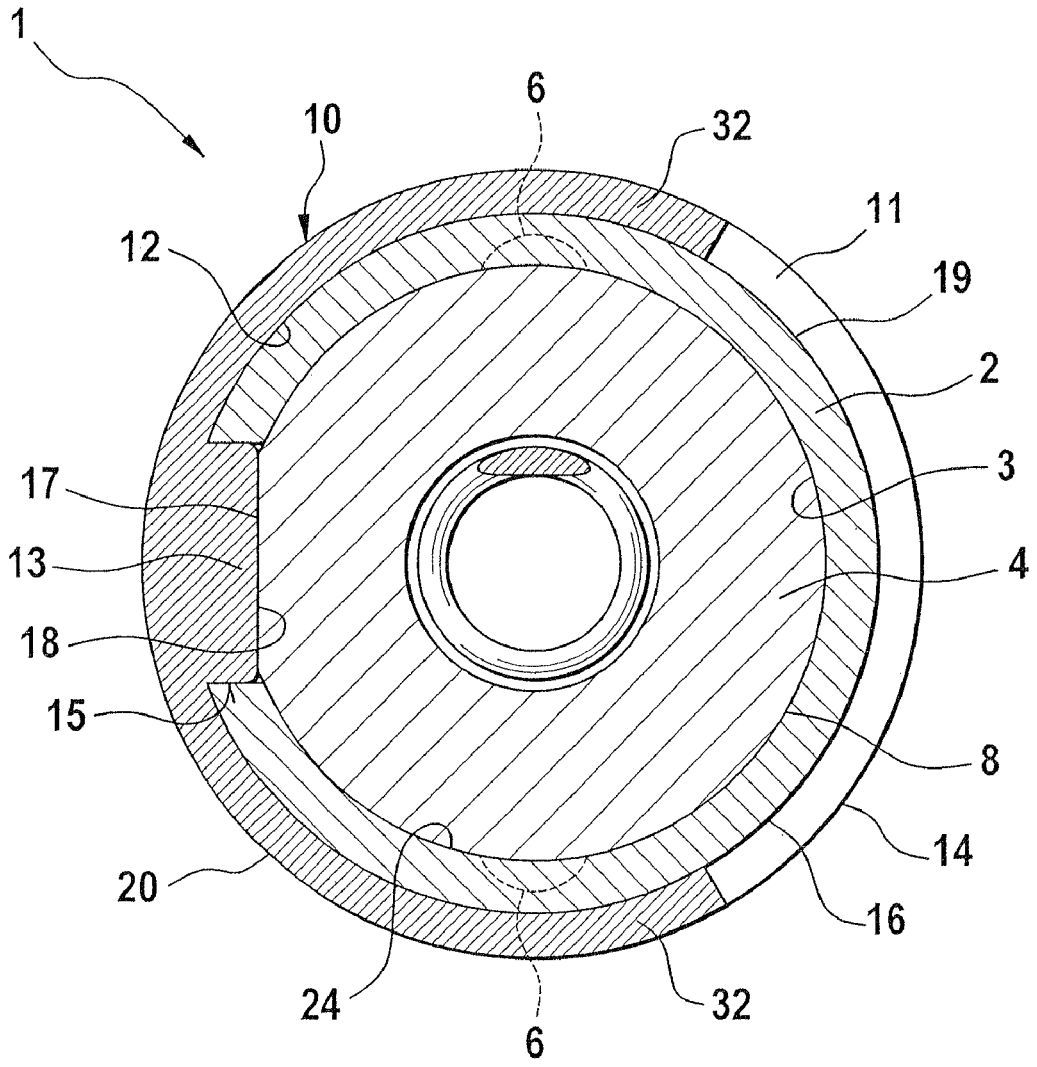
FIG. 2 shows an enlarged cross-section through the component of FIG. 1 taken in a region of a ring of this component.

As illustrated, an anti-rotation device 10 is arranged between the inner element 4 and the housing 2. This device comprises a thin-walled ring having a slit 11. As shown in FIG. 2, this slit 11 extends over approximately one quarter of an outer peripheral surface 14 of the housing 2.

As can be seen in FIG. 2, a rectangular extension 13 projects inwards from a central position from an inner peripheral surface 12 of the ring 10 and has a flat inner surface 18. The ring 10 is fixed in an annular groove 19 in the outer peripheral surface 14 of the housing 2. Advantageously the ring 10 does not project with its outer peripheral surface 20 beyond the outer peripheral surface 14 of the housing 2.

As a person skilled in the art will further understand from the drawing, the aforesaid extension 13 extends in a complementary aperture 15 of the housing 2. This aperture 15 can be made, for instance, by punching.

A longitudinal flattened portion provided on the outer peripheral surface 16 of the inner element 4 constitutes a counter surface 17 for the extension 13. To prevent rotation, the inner surface 18 of the extension 13 extends directly on this flattened portion. For assembly, the ring 10 is held parallel to a transverse plane of the component 1 and slipped onto the outer peripheral surface 14 of the housing 2, with the slit foremost or it is pushed axially onto the component 1 from above, with its legs 32 slightly spread out.

The aforesaid anti-rotation device 10 formed with the help of the ring is necessary, for instance, for a correct orientation of the piston-type coupling means 5 relative to the segment-shaped cavity that forms the entraining surface 6. The anti-rotation device can also become necessary if a conveyance of hydraulic medium into the interior of the component 1 (for instance, to a hydraulic lash adjuster or to the coupling means 5 in the inner element 4) must be realized without having recourse to annular grooves.

If the stack of circlips 25 disclosed in the drawing is omitted, it is also possible to configure the ring 10 at the same time as a stop means 9. In this case, stopping is achieved by an abutment of a lower edge 21 of the counter surface 17 of the inner element 4 formed by the longitudinal flattened portion against an underside 22 of the extension 13 of the ring 10.

As mentioned above, the component 1 of FIG. 1 can be designed as a support element. A head 29 (not shown in full) of the inner element 4 protrudes beyond an upper edge 30 of the housing 2 and serves as a support for at least one lever-type cam follower (finger follower). Through an outer peripheral surface 14, the housing 2 can be fixed in position in a reception of a cylinder head and hydraulic medium can be conveyed to this reception for switching the coupling means 5 and for supply to the hydraulic lash adjuster installed in the inner element 4.

LIST OF REFERENCE NUMERALS

1 Component
2 Housing
3 Bore
4 Inner element
5 Coupling means
6 Entraining surface
7 Lost motion spring
8 Annular gap
9 Stop means
10 Anti-rotation device, ring
11 Slit
12 Inner peripheral surface
13 Extension
14 Outer peripheral surface
15 Aperture
16 Outer peripheral surface of inner element
17 Counter surface
18 Inner surface
19 Annular groove
20 Outer peripheral surface of ring
21 Lower edge
22 Underside of ring
23 Annular groove
24 Inner peripheral surface of housing
25 Circlip, stack of circlips
26 Lower edge
27 Lower surface
28 Diameter reduction
29 Head
30 Edge
31 Underside
32 Leg

The invention claimed is:

1. A switchable component for a valve train of an internal combustion engine, said component comprising:

a housing in whose bore an axially displaceable inner element is received, at least one coupling means being arranged in the inner element, said coupling means, for effecting coupling axially distant relative position of the inner element to the housing, being able to be brought partially into engagement with an entraining surface of the housing, the inner element being biased in outward direction from the housing by at least one lost motion spring, an axially fully extended position of the inner element being defined by a stop means overlapping an annular groove between the inner element and the housing, and an anti-rotation device being arranged between the inner element and the housing, wherein the anti-rotation device is a thin-walled ring comprising a slit, a central rectangular extension situated diametrically opposite the slit projects inwards from the inner peripheral surface of said ring which extends parallel to a transversal plane of the component on an outer peripheral surface of the housing, the housing comprises an aperture that is complementary in shape to the extension of the ring and said extension extends through said aperture, a counter surface for the extension extends in the form of a longitudinal flattened portion or a longitudinal groove in the outer peripheral surface of the inner element and, for effecting anti-rotation, the extension extends with a complementary inner surface directly on or into said counter surface, and wherein the ring has a substantially C-shaped profile or a substantially U-shaped profile, is seated securely in an annular groove in the outer peripheral surface of the housing and does not project with an outer peripheral surface beyond the outer peripheral surface of the housing.

2. Component according to claim 1, wherein ring is configured at the same time as the stop means, and stopping is effected by an abutment of a lower edge of the counter surface of the inner element against an underside of the extension of the ring.

3. Component according to claim 2, wherein ring forming the stop means at the same time enables an adjustment of a coupling position of the coupling means with coupling lash relative to the entraining surface.

4. Component according to claim 1, wherein at least one circlip or a stack of circlips forming the stop means is seated in an annular groove in the inner peripheral surface of the housing and projects radially inwards slightly beyond the annular groove, and for effecting stopping, a lower surface of a corresponding diameter reduction of the outer peripheral surface of the inner element comes to abut against a lower edge of the circlip/stack of circlips.

5. Component according to claim 4, wherein the circlip/stack of circlips at the same time enables an adjustment of a coupling position of the coupling means with coupling lash relative to the entraining surface.

6. Component according to claim 1, wherein the component is configured as a support element whose inner element projects with a head beyond an edge of the housing to form a support for a lever-type cam follower, and the support element is suited for being installed through an outer peripheral surface in a reception of a cylinder head.

7. Component according to claim 1, wherein the component is configured as a roller or mushroom-type tappet, an underside of the housing is designed for cooperating with a lifting cam, and the inner element forms at another end, a support for a tappet pushrod.

8. Component according to claim 1, wherein legs of the extension extending away on two sides from the extension surround at least more than one half to about ¾ of a circumference of the outer peripheral surface of the housing.

* * * * *